US005280654A

United States Patent [19]

Wolfer

[11] Patent Number: 5,280,654

[45] Date of Patent: Jan. 25, 1994

[54] COMMODE SEAT LID LIFT APPARATUS

[76] Inventor: James M. Wolfer, 1004 Eolus Ave., Leucadia, Calif. 92024

[21] Appl. No.: 967,422

[22] Filed: Oct. 28, 1992

[51] Int. Cl.[5] ..... A47K 13/10

[52] U.S. Cl. ..... 4/246.1; 4/246.3

[58] Field of Search ..... 4/223, 228.1, 229, 230, 4/231, 232, 233, 246.1, 246.3, 246.4, 246.5, 246.2; 220/264, 343

[56] References Cited

U.S. PATENT DOCUMENTS

| | | | |
|---|---|---|---|
| 548,870 | 10/1895 | Hager | 4/223 |
| 713,977 | 11/1902 | Gallagher | 4/229 |
| 1,910,282 | 5/1933 | Ellis | 220/264 |
| 2,705,330 | 4/1955 | Knudsen | 4/246.1 |
| 4,766,619 | 8/1988 | Takeda | 4/246.1 |
| 5,195,648 | 3/1993 | Harris | 220/343 |

FOREIGN PATENT DOCUMENTS

| | | | |
|---|---|---|---|
| 2238803 | 6/1991 | United Kingdom | 4/246.1 |

*Primary Examiner*—Henry J. Recla
*Assistant Examiner*—Charles R. Eloshway
*Attorney, Agent, or Firm*—Leon Gilden

[57] ABSTRACT

A gear housing includes a first gear axle parallel to a second gear axle, with the first axle in fixed communication with a lift lever to effect rotation of the first axle and associated first gears to effect rotation of second gears about the second axle, with the second axle mounted to the commode seat to simultaneously lift the commode seat and lid in a unitary manner.

4 Claims, 4 Drawing Sheets

COMMODE SEAT LID LIFT APPARATUS

BACKGROUND OF THE INVENTION

1. Field of the Invention

The field of invention relates to commode seat lift structure, and more particularly pertains to a new and improved commode seat lid lift apparatus wherein the same simultaneously effects the lifting of a commode lid and seat relative to an associated commode assembly.

2. Description of the Prior Art

The manual lifting of commode seats, particularly in commercial establishments, is not only undesirable but may at times contribute to the spreading of disease and unknown contamination. The instant invention attempts to overcome deficiencies of the prior art by providing for a structure of compact and unitary mounting relative to a commode assembly to provide for the simultaneous lifting of a commode seat and lid, particularly for use by males in the commode structure. The U.S. Pat. Nos. 4,951,324; 4,803,741; 4,534,073; and 3,504,385 are examples of prior art structure arranged to the lifting of commode seat structure.

The instant invention attempts to overcome deficiencies of the prior art by providing for an organization directed to the simplicity and ease of mounting and retrofit of the organization relative to existing commode structure, as well as to the employment of such an original manufacture of such commode structure and in this respect, the present invention substantially fulfills this need.

SUMMARY OF THE INVENTION

In view of the foregoing disadvantages inherent in the known types of commode seat lid lift apparatus now present in the prior art, the present invention provides a commode seat lid lift apparatus wherein the same includes an extension lever operative through a gear housing to effect the simultaneous lifting of a commode seat and lid structure. As such, the general purpose of the present invention, which will be described subsequently in greater detail, is to provide a new and improved commode seat lid lift apparatus which has all the advantages of the prior art commode lid lifting structure and none of the disadvantages.

To attain this, the present invention provides a gear housing including a first gear axle parallel to a second gear axle, with the first axle in fixed communication with a lift lever to effect rotation of the first axle and associated second gears about the second axle, with the second axle mounted to the commode seat to simultaneously lift the commode seat and lid in a unitary manner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode seat lid lift apparatus which has all the advantages of the prior art commode seat lid lift structure and none of the disadvantages.

It is another object of the present invention to provide a new and improved commode seat lid lift apparatus which may be easily and efficiently manufactured and marketed.

It is a further object of the present invention to provide a new and improved commode seat lid lift apparatus which is of a durable and reliable construction.

An even further object of the present invention is to provide a new and improved commode seat lid lift apparatus which is susceptible of a low cost of manufacture with regard to both materials and labor, and which accordingly is then susceptible of low prices of sale to the consuming public, thereby making such commode seat lid lift apparatus economically available to the buying public.

Still yet another object of the present invention is to provide a new and improved commode seat lid lift apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
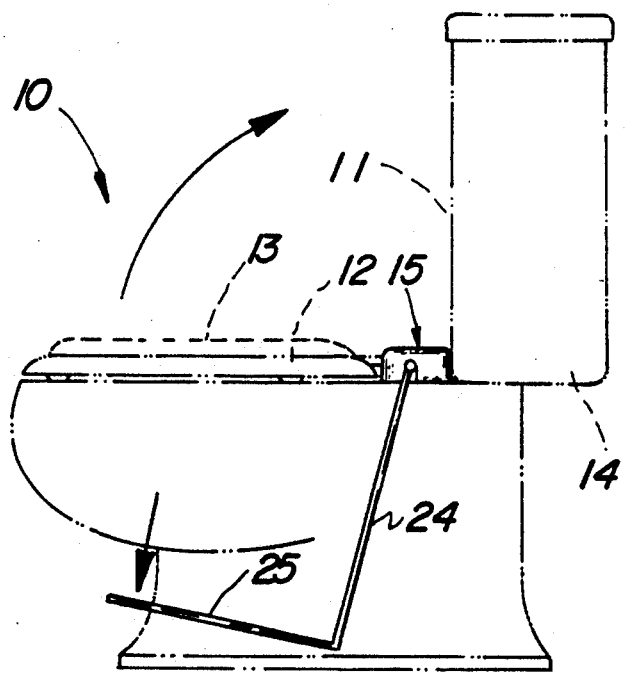
FIG. 1 is an orthographic side view of the invention.
Figure 2:
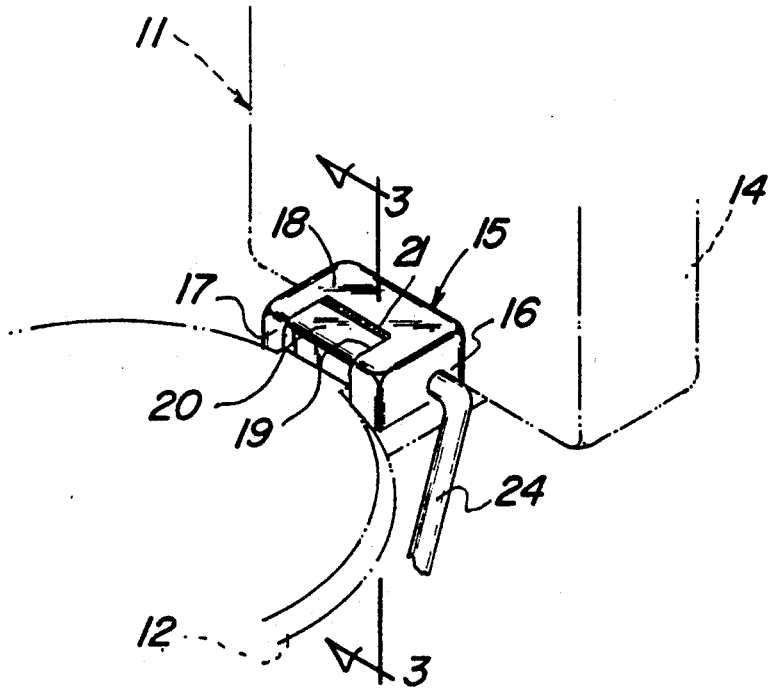
FIG. 2 is an isometric illustration of the gear housing structure mounted to a commode assembly.

With reference now to the drawings, and in particular to FIG. 1 to 10 thereof, a new and improved commode seat lid lift apparatus embodying the principles and concepts of the present invention and generally designated by the reference numeral 10 will be described.

More specifically, the commode seat lid lift apparatus 10 of the instant invention essentially comprises a commode assembly 11 of a generally conventional construction, having a commode seat 12 and a commode seat lid 13 positioned over the seat 12 in a hinged pivotal relationship, with the seat 12 hingedly mounted relative to the commode assembly 11 in adjacency to the commode tank 14. A gear housing 15 is provided mounted intermediate the tank 14 and the seat 12. It should be noted that as the commode seat 12 is lifted, the lid 13 that in turn is hingedly mounted to the seat 12, is lifted therewith. A gear housing 15 is provided with housing spaced parallel side walls 16, a front wall 17, and a top wall 18. The front wall 17 and the top wall 18 include an opening 19 directed therethrough, having an L-shaped lid 20 hingedly mounted about a spring hinge 21 to the front wall 17 to extend over the opening 19 when the commode seat 12 is in a first position in communication with the commode assembly 11 bowl, in a manner as indicated in FIG. 1.

Figure 3:
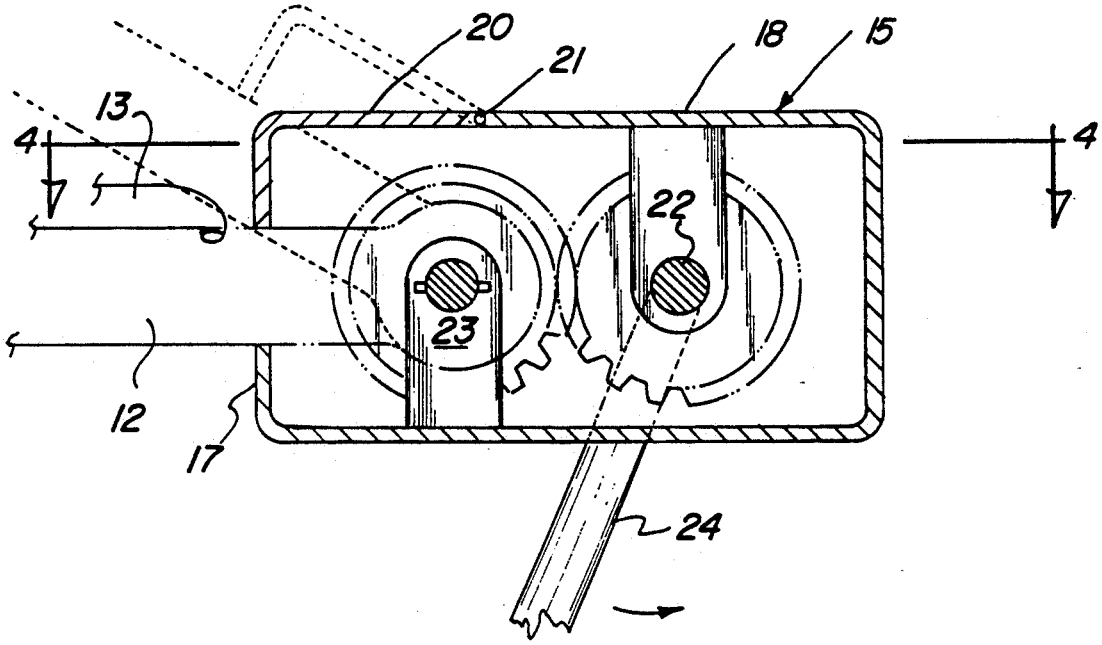
FIG. 3 is an orthographic view, taken along the lines 3—3 of FIG. 2 in the direction indicated by the arrows.
Figure 4:
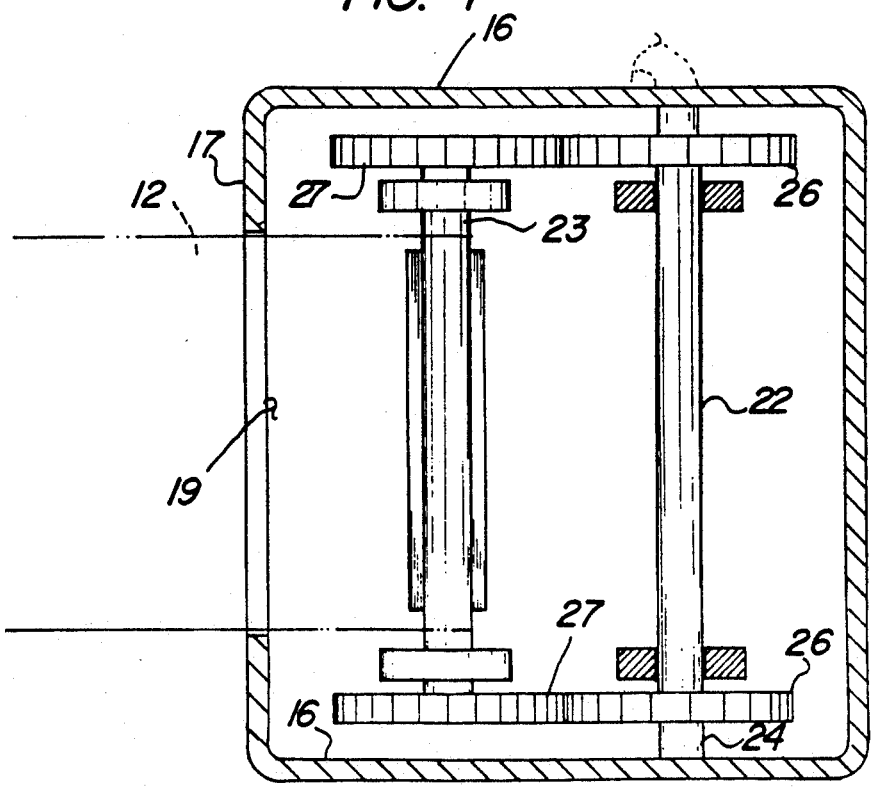
FIG. 4 is an orthographic view, taken along the lines 4—4 of FIG. 3 in the direction indicated by the arrows.
Figure 5:
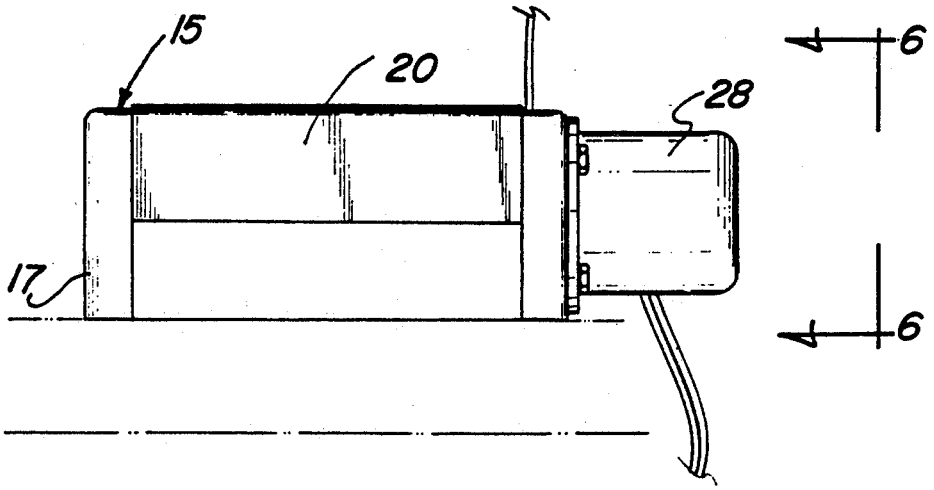
FIG. 5 is an orthographic frontal view of the structure employing a motor drive.

The gear housing side wall 16 includes respective first and second parallel gear axles 22 and 23 directed therewithin, with the second gear axle 23 positioned in adjacency to the front wall 17 having the commode seat 12 fixedly mounted thereto (see FIG. 3 for example). First gear axle 22 includes an L-shaped lever 24 mounted fixedly thereto extending through at least one of the side walls and having a lever foot plate 25 fixedly mounted to a free distal end of the L-shaped lever 24, in a manner as indicated in FIG. 1, as the L-shaped lever 24 extends substantially to a lower end portion of the commode assembly 11. In this manner, rotation of the lever 24 effects simultaneous rotation of the first gear axle 22, with the first gear axle 22 having first gears 26 mounted thereto in cooperation with respective second gears 27. It should be noted each first gear 26 is in cooperation with one of the second gears 27, in a manner as indicated in FIG. 4, to effect simultaneous contra-rotation of the second gear axle 23 and the commode seat 12.

In lieu of the lever structure 24 and 25, a reversal drive motor 28 may be provided having electrical transition cable 30 in cooperation with a raising and lowering of a three-way switch 29 to effect rotation and contra-rotation of the reversal drive motor 28 to effect a raising and lowering of the associated commode lid and seat structure in lieu of the use of the first L-shaped lever 24 and the lever foot plate 25.

Figure 6:
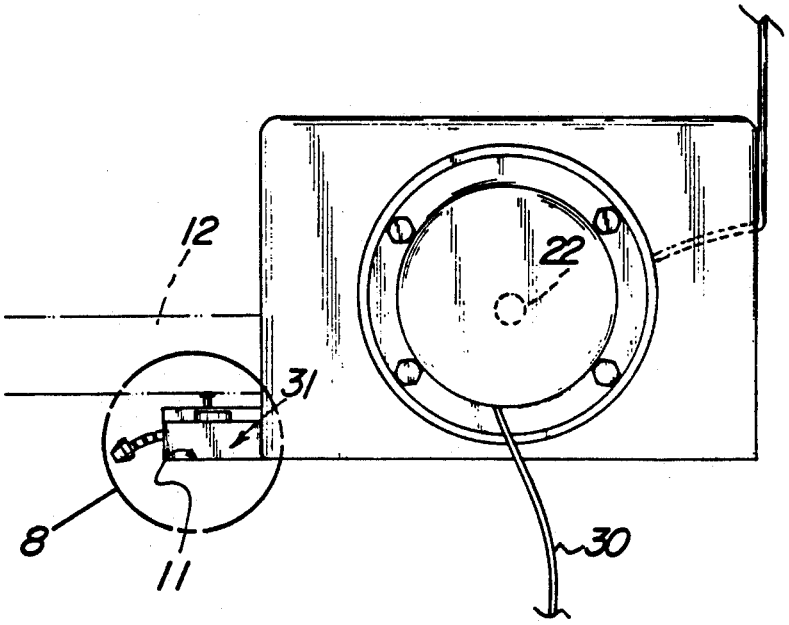
FIG. 6 is an orthographic view, taken along the lines 6—6 of FIG. 5 in the direction indicated by the arrows.
Figure 7:
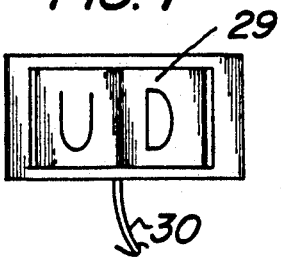
FIG. 7 is an orthographic view of a control switch structure utilized by the invention as set forth in FIGS. 5 and 6.
Figure 8:
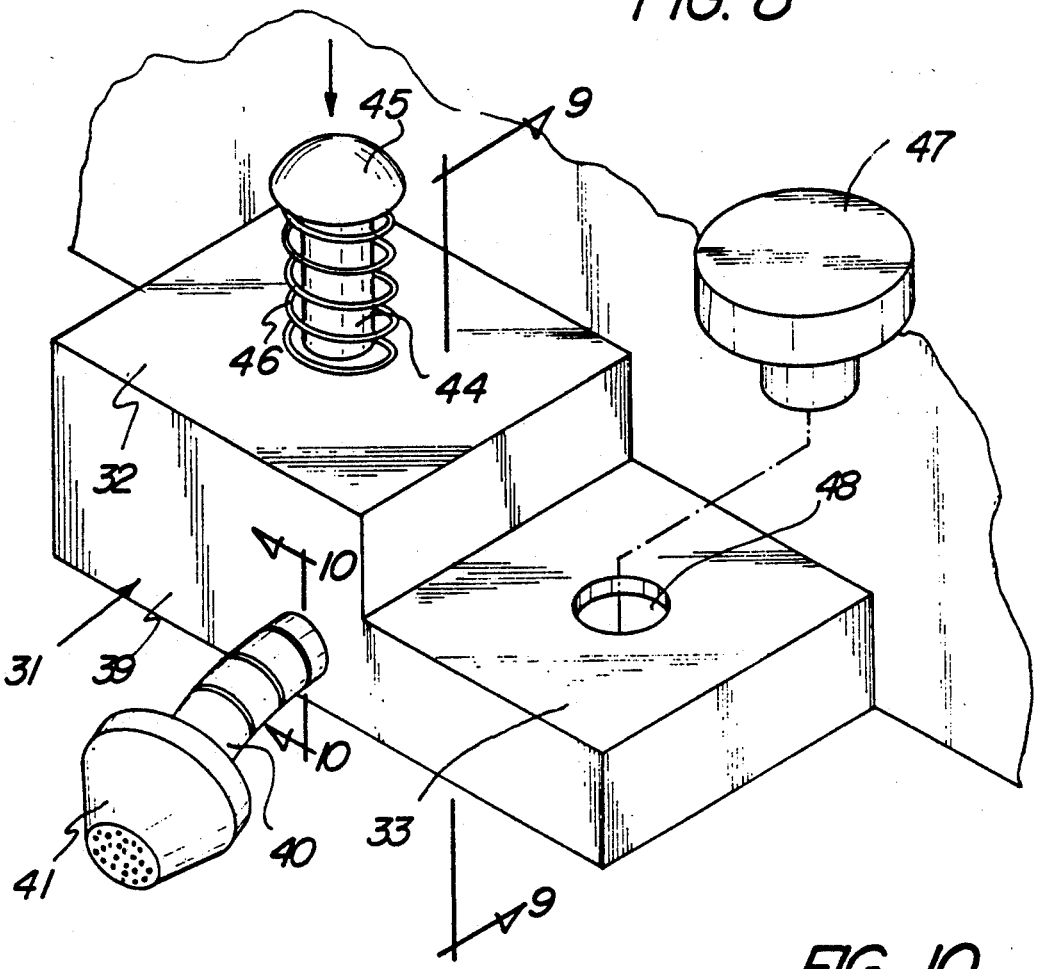
FIG. 8 is an isometric illustration enlarged of section 8 as set forth in FIG. 6 to employ a deodorizing distribution structure with the organization of the invention.
Figure 10:
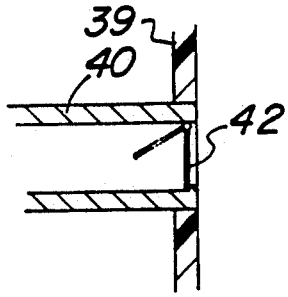
FIG. 10 is an orthographic view, taken along the lines 10—10 of FIG. 8 in the direction indicated by the arrows.

The structure of FIG. 6 indicates the use of a fluid dispensing housing 31, where it is indicated in FIG. 6 for purposes of brevity, but it should be understood that the dispensing housing 31 may be equally employed with the commode lift apparatus, as indicated in the FIGS. 1-4 in cooperation with the commode seat 12, in a manner as indicated in FIG. 6. The fluid dispensing housing 31 is arranged to dispense a deodorizing fluid into the commode bowl onto the commode seat upon return of the commode seat 12 to the first position from a raised second position, as indicated in FIG. 3.

Figure 9:
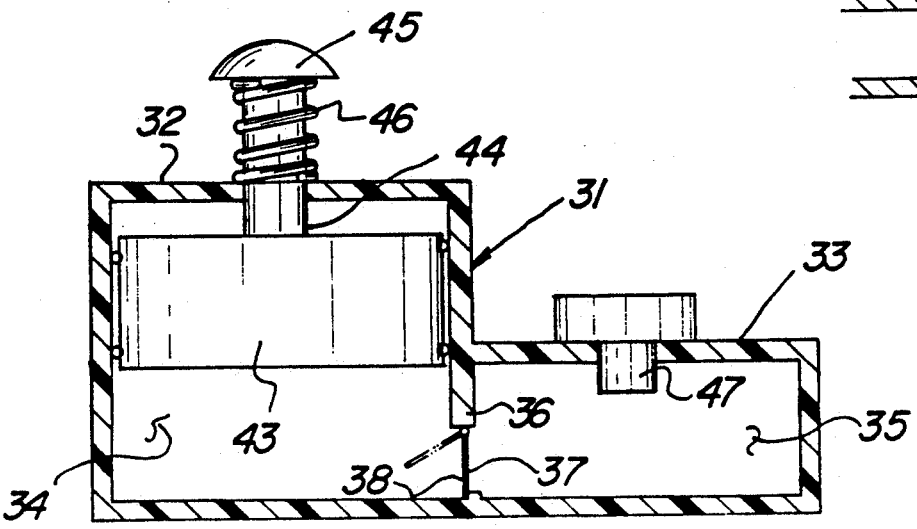
FIG. 9 is an orthographic view, taken along the lines 9—9 of FIG. 8 in the direction indicated by the arrows.

The dispensing housing 31 includes a dispensing housing first top wall 32 and a housing second top wall 33, with the housing second top wall 33 oriented below the first top wall 32. The second top wall 33 is thusly spaced to avoid contact with a fill plug 47 removable from a fill plug opening 48 through the second top wall to permit replenishment of deodorizing fluid within the second reservoir cavity 35 below the second top wall. The first top wall in a similar manner is positioned over a first reservoir cavity 34 (see FIG. 9), with an interface wall 36 oriented between the first and second reservoir cavities 34 and 35. A fluid port 37 is directed through the interface wall 36, having a first check valve door plate 38 arranged to permit fluid to be directed from the second reservoir cavity to the first reservoir cavity only. This is accomplished by a door plate mounted upon a spring hinge and is normally biased into a first floor abutment, as indicated in FIG. 9, whereupon as a piston 43 is raised within the first reservoir cavity, such suctioning directs fluid from the second reservoir cavity 35 to the first reservoir cavity 34, such as indicated in phantom in FIG. 9. Further, the dispensing housing having a dispensing housing front wall 39 includes a front wall conduit 40 directed in communication with the second reservoir cavity 34, with the front wall conduit 40 having a multi-apertured nozzle 41 terminating at the front wall conduit 40. To insure that fluid projects through the conduit 40 only upon projection of the piston 43 downwardly to the floor of the dispensing housing 31, a check valve door plate 42 is mounted within the conduit 40 at the housing front wall 39 wherein as in the first check valve door plate 38, a conduit abutment mounted within the conduit 40 spaced from a spring hinge of the second check valve door plate 42 only permits fluid egress through the conduit 40 upon projection of the piston 43 downwardly to the housing floor. The piston 43 is provided within a piston rod 44 projecting through the first top wall 32, having a rod head 45, with a piston rod spring 46 captured between the rod head 45 and the first top wall 32 to normally bias the piston in a raised orientation. In this manner, upon the lid 12 being directed into the first position from the second position, fluid is directed only through the conduit 40 and the nozzle 41 positioned over the commode bowl below the seat 12. When the commode seat is raised to the second position, as indicated in the FIG. 3, the spring 46 biases the piston 43 to a raised orientation, as indicated in FIG. 9, to direct fluid from the second reservoir cavity 35 to the first reservoir cavity 34 for its replenishment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode seat lid lift apparatus arranged for securement to a commode assembly, having a commode seat and a commode bowl, with the commode seat pivotally mounted relative to the commode bowl, with the apparatus comprising, a gear housing, the gear housing including spaced parallel housing side walls, a housing front wall, and a housing top wall, an opening is directed through the top wall and the front wall, with an L-shaped lid including a spring hinge, with the spring hinge fixedly mounted to the gear housing top wall in confrontation with the opening, with the L-shaped lid arranged for overlying the opening in a first position, with a first gear axle and a second gear axle rotatably mounted between the side walls, with the second gear axle including the commode seat fixedly mounted thereto, with the commode seat oriented in a first horizontal orientation in the first position and arranged in a displaced orientation relative to the commode bowl in a second position, with the first axle having at least one first gear, and the second axle having at least one second gear, wherein the first gear is arranged for intermeshing with the second gear, and the first gear axle includes at least one L-shaped lever directed through one of the side walls in fixed communication with the first gear and axle, and the L-shaped lever including a lever foot plate fixedly mounted to the L-shaped lever at a spaced distal end of the L-shaped lever spaced from the gear housing, and the lever foot plate permitting rotation of the L-shaped lever and simultaneous rotation of the first gear axle to effect rotation of the second gear axle and lifting of the L-shaped lid from the first position to the second position.

2. An apparatus as set forth in claim 1 including the housing front wall having a fluid dispensing housing positioned in adjacency to the housing front wall below the commode seat, with the fluid dispensing housing including a housing first top wall and a housing second top wall, with the housing second top wall spaced below the housing first top wall, and a first reservoir cavity positioned within the dispenser housing below the first top wall, and a second reservoir cavity positioned within the dispensing housing below the second top wall, and an interface wall coextensive between the first reservoir cavity and the second reservoir cavity, and a fluid port directed through the interface wall, and a first check valve mounted within the fluid port permitting fluid flow only between the first reservoir cavity to the second reservoir cavity, and the dispensing housing having dispensing housing front wall, the dispensing housing front wall including a conduit directed therethrough in communication with the second reservoir cavity, the conduit having a conduit free end spaced from the dispensing housing front wall, and the conduit free end including a nozzle arranged for orientation over the commode bowl, and drive means within the first reservoir cavity to direct fluid from the first reservoir cavity through the conduit and the nozzle into the commode bowl.

3. An apparatus as set forth in claim 2 wherein the drive means includes a piston reciprocatably mounted within the first reservoir cavity and the conduit having a conduit check valve means for permitting fluid flow from the second reservoir cavity into the conduit, wherein the dispensing housing includes a housing floor positioned below the first top wall and the piston is arranged for reciprocation between the floor and the first top wall, and the piston having a piston rod directed through the top wall, and the rod having a rod head spaced above the first top wall, and a spring interposed between the rod head and the first top wall biasing the piston in a raised orientation and directing the piston to the floor in a lowered orientation when the commode seat is directed into the first position from the second position.

4. An apparatus as set forth in claim 3 wherein the second top wall includes a second top wall opening, and a fill plug removably mounted relative to the second top wall opening for directing fluid into the second reservoir cavity through the second top wall opening.

* * * * *